US005938043A

United States Patent [19]

Costin et al.

[11] Patent Number: 5,938,043

[45] Date of Patent: Aug. 17, 1999

[54] CENTRIFUGAL JIG

[75] Inventors: C. Patrick Costin; David B. Lloyd, both of Reno, Nev.

[73] Assignee: Fine Gold Recovery Systems, Inc., Cody, Wyo.

[21] Appl. No.: 08/862,285

[22] Filed: May 23, 1997

[51] Int. Cl.[6] ..... B03B 5/12; B03B 5/06; B03B 11/00

[52] U.S. Cl. ..... 209/425; 209/444; 209/486; 209/498; 209/500; 209/505

[58] Field of Search ..... 209/425, 426, 209/427, 444, 486, 498, 500, 505

[56] References Cited

U.S. PATENT DOCUMENTS

| | | | |
|---|---|---|---|
| 1,770,854 | 7/1930 | Johnson . | |
| 3,334,751 | 8/1967 | Jaekel et al. | 210/380 |
| 3,955,754 | 5/1976 | Schaper | 233/2 |
| 4,247,392 | 1/1981 | Goncharov | 209/301 |
| 4,279,741 | 7/1981 | Campbell | 209/44 |
| 4,319,990 | 3/1982 | Muller | 209/240 |
| 4,405,454 | 9/1983 | Hultsch et al. | 209/279 |
| 4,454,041 | 6/1984 | Kelsey | 210/235 |
| 4,515,689 | 5/1985 | Vivier | 209/505 |
| 4,574,046 | 3/1986 | Sprow | 209/500 |
| 4,608,040 | 8/1986 | Knelson | 209/486 |
| 4,776,833 | 10/1988 | Knelson | 209/486 |
| 4,898,666 | 2/1990 | Kelsey | 209/425 |
| 4,998,986 | 3/1991 | Campbell | 209/44 |
| 5,114,569 | 5/1992 | Kelsey | 209/425 |
| 5,361,910 | 11/1994 | Yang et al. | 209/425 |
| 5,401,407 | 3/1995 | Jones et al. | 210/369 |
| 5,458,776 | 10/1995 | Preisser et al. | 210/378 |

*Primary Examiner*—William E. Terrell
*Assistant Examiner*—Joe Dillon, Jr.
*Attorney, Agent, or Firm*—Wells, St. John, Roberts, Gregory & Matkin P.S.

[57] ABSTRACT

An improved jig screen for a centrifugal jig includes a recovery zone and a stratification zone adjacent to one another. The stratification zone is constructed to prohibit outward radial passage of slurry particles while permitting fluid pulsations to be imparted to the slurry during jig screen rotation. The stratification zone axially leads to the recovery zone. The recovery zone has openings permitting passage of particles in the slurry and through which fluid pulsations are directed to the slurry during jig screen rotation. The combination of applying centrifugal force and fluid pulsations to a pre-stratified slurry more effectively separates the heavy particles passing through the recovery zone of the jig screen from the lightweight particles discharged at its exit end.

32 Claims, 3 Drawing Sheets

CENTRIFUGAL JIG

TECHNICAL FIELD

This invention relates to jigs utilizing centrifugal force to enhance the separation of heavy and lightweight fractions in a mineral-containing pulp or slurry.

BACKGROUND OF THE INVENTION

The present invention pertains to improvements in centrifugal jigs. Specific examples of centrifugal jigs are disclosed in U.S. Pat. No. 4,279,741 to Campbell, issued Jul. 21, 1981 and titled "Method and Apparatus for Centrifugally Separating a Heavy Fraction From a Light Weight Fraction Within a Pulp Material" and in U.S. Pat. No. 4,998,986 to Campbell, issued Mar. 12, 1991 and titled "Centrifugal Jig Pulsing System." Both patents are hereby incorporated into this disclosure by reference.

The general advantages and operational features of centrifugal jigs can be readily ascertained from the above-referenced patents. Depending upon the specific application of such a jig, either the heavy fraction or the lightweight fraction separated by its operation might contain the values desired as an end product.

In a centrifugal jig, a rotor is provided to act upon an incoming pulp or slurry. The rotor includes a rotating jig screen and a surrounding rotating hutch. The hutch is maintained full of fluid during operation. Fluid pulses are directed to the interior space of the hutch by a pulsator, such as a rotating supply valve or by pulse blocks which are mounted to the rotor and which spin with it about its central axis. Other forms of internal or external fluid pulsators may be utilized in conjunction with the improvement of the present disclosure.

In a centrifugal jig of the type disclosed in the above-identified patents, a pre-screened incoming pulp or slurry containing heavy and light fractions in a range of particle sizes is introduced directly onto the separating jig screen. The jig screen has openings formed through it of a size sufficient to permit radial outward passage of the particles in the slurry.

The theory of operation of such a jig assumes that the pulsing of the slurry on the perforated screen will first radially stratify the particles according to their specific gravities, and that then the heavier particles will escape through the screen openings as a result of centrifugal force. However, because stratification of the similarly-sized particles into heavy and lightweight fractions typically occurs along the axial length of the separating screen itself, some particles in the lightweight fraction inevitably will become entrapped within the particles of the heavy fraction as the heavy fraction migrates toward the screen surface.

Entrapped lightweight particles are usually discharged along with the heavy particles. Their presence decreases the overall percentage of heavy particles in the resulting recovered fraction. The extent of this problem is a function of the nature of the materials and particle sizes within the incoming slurry and the relative specific gravities of the lightweight and heavy fractions contained within it. In actual practice, the significance of the resulting dilution of recovered material varies substantially from one specific application to another.

The present disclosure utilizes a split screen to address the problem created by the escape of lightweight particles prior to slurry stratification. The incoming slurry is first directed onto a stratification section of the jig screen along which the slurry is radially pulsated. This stratifies the particles according to their respective weights, with the heavier particles being positioned radially outward from those of lesser weight. However, no particles are permitted to escape radially through this section as such layering is accomplished.

After being pre-stratified, the slurry is then directed onto a recovery screen section for separation of its lightweight and heavy fractions as detailed in the above-identified patents. Depending upon the nature of a particular slurry, substantially higher degrees of separation can be achieved by such pre-stratification. The required radial movement of heavier particles that takes place during separation on the jig screen is not accomplished in competition with the stratification of the particles along the same jig screen surface. Lightweight particles are therefore less likely to become entrapped by the outwardly migrating heavy particles.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The drawings diagrammatically show a cross-section of a modified centrifugal jig including the present improvement, as well as details and alternative diagrammatic cross-sectional views of the improved jig screen. For more details concerning the various centrifugal jig components and their operation, reference should be made to the disclosures in the referenced U.S. Pat. Nos. 4,279,741 and 4,998,986.

In such a jig, the incoming slurry is subjected to centrifugal forces and fluid pulsations to create a fluidic particle bed moving along the axial length of the jig screen. The forces imparted to the particles in the slurry due to periodic fluid pulses "jig" the slurry in opposition to centrifugal forces holding the slurry against the inner surface of the jig screen 10.

As the slurry moves axially along jig screen 10, stratification of the particles as a function of specific gravity and particle size will occur. The heavier particles will gravitate toward the jig screen 10. They will be discharged radially outwardly through openings formed through the jig screen 10. The lighter particles will continue along the axial length of the jig screen 10. They will be discharged at the far axial end of the jig screen 10 for collection apart from the heavier particles.

The present improvement utilizes an annular jig screen 10 that is formed about a central axis Y—Y for use within the centrifugal jig. The improved jig more effectively separates particles within a common size range within a pulp or slurry into a heavy fraction and a lightweight fraction.

Figure 2:
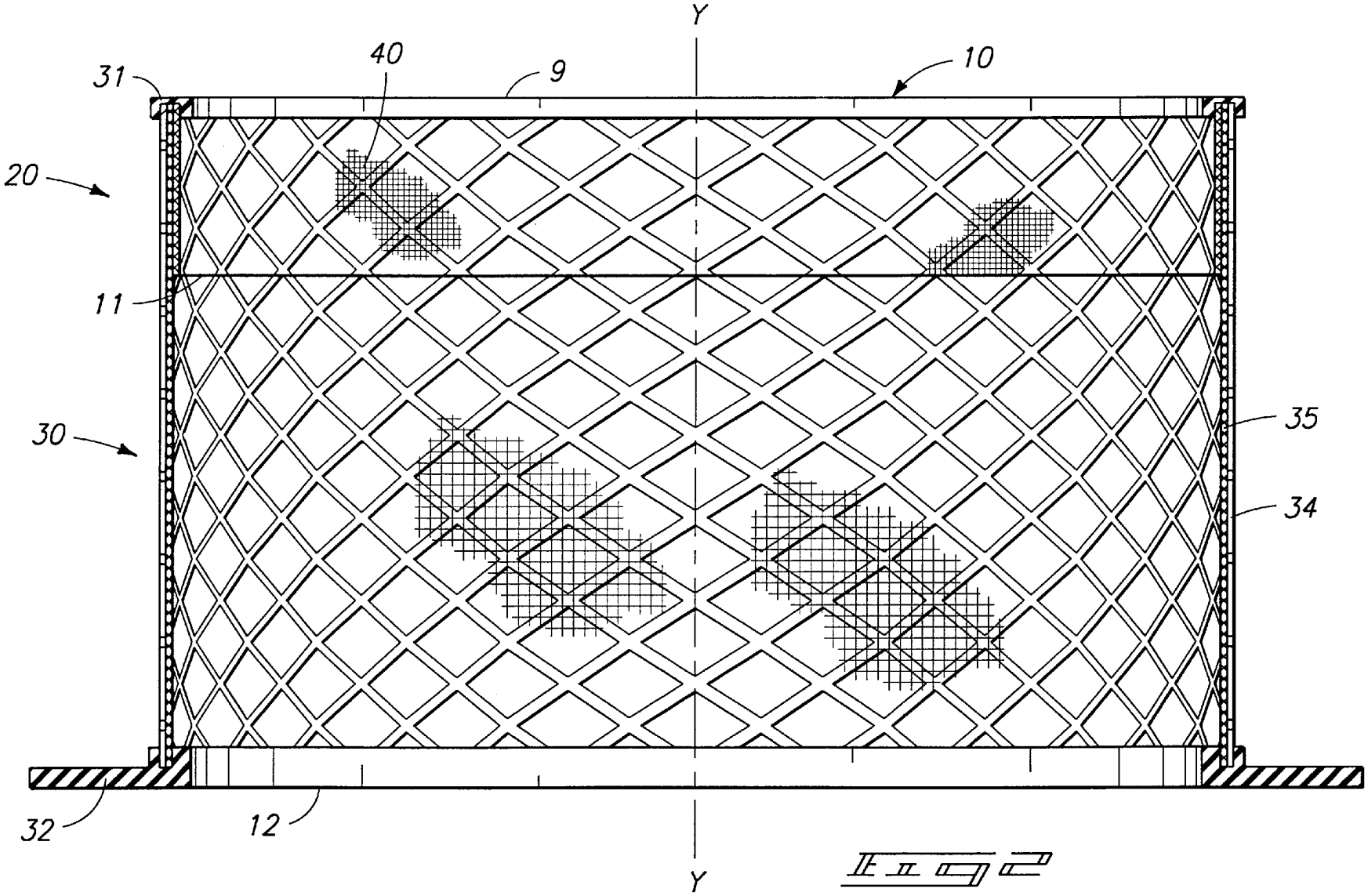
FIG. 2 is an enlarged cross-sectional view illustrating the jig screen shown in FIG. 1.
Figure 3:
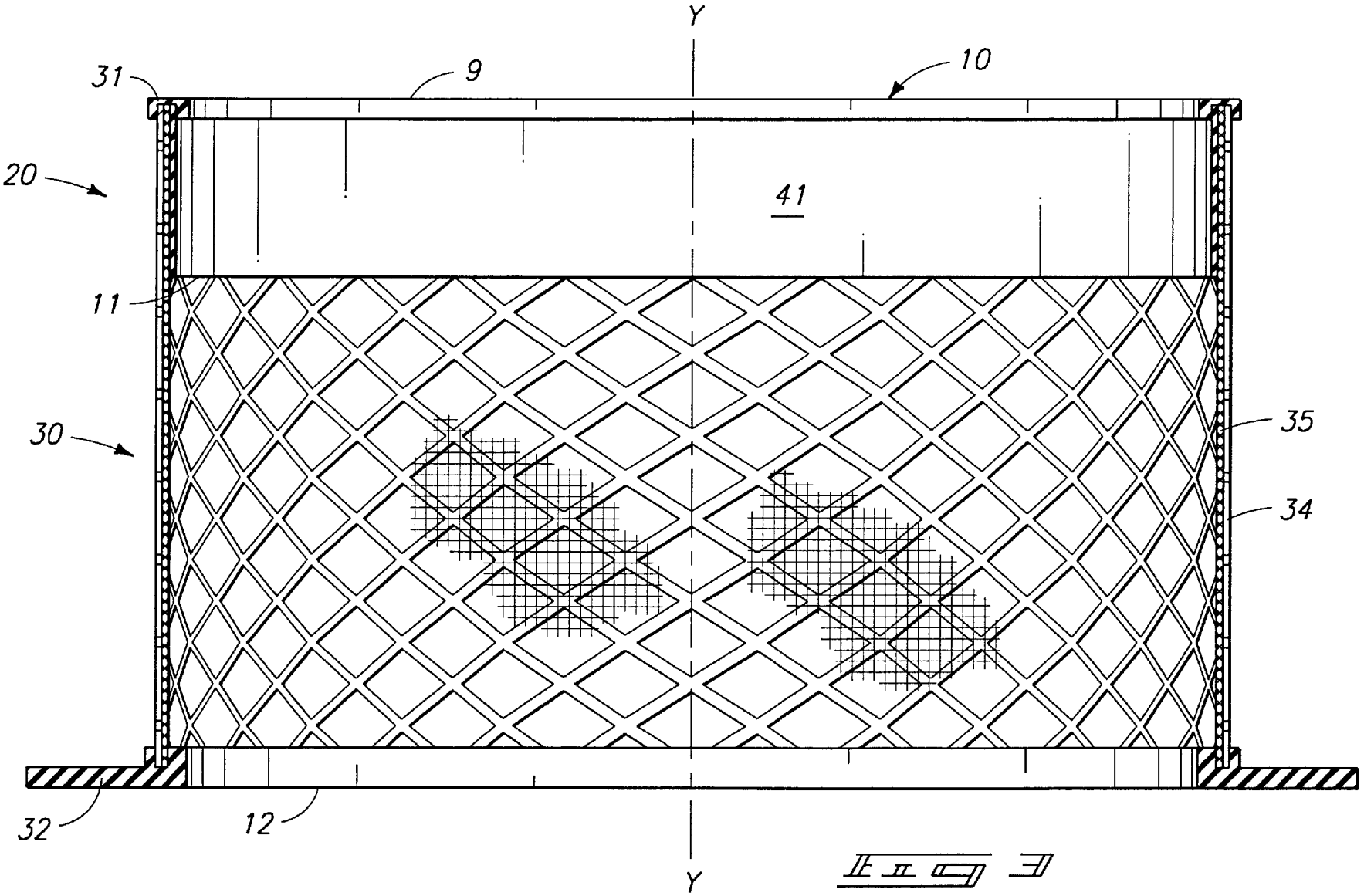
FIG. 3 is a view similar to FIG. 2, illustrating an alternative jig screen structure.

The improved jig screen 10 is a "split screen" that includes a stratification zone 20 and a recovery zone 30 (see FIGS. 2 and 3). The stratification zone 20 and recovery zone 30 are adjacent to one another. Both are centered along a common central axis Y—Y. They preferably have substantially identical inside diameters.

Recovery zone 30 extends axially along the central axis Y—Y between a first annular end 11 where slurry enters the recovery zone 30 and a spaced second annular end 12 at the bottom of jig screen 10 where the remaining lightweight fraction of slurry is discharged from within the jig screen 10. Stratification zone 20 also extends axially along the central axis Y—Y. It begins at an annular edge 9 at the top end of jig screen 10 and leads to the first annular end 11 at the upper end of recovery zone 30.

In the preferred form of the invention, the annular jig screen 10 is cylindrical. In other embodiments of the invention, the inside diameter of annular jig screen 10 varies along central axis Y—Y. Both the stratification zone 20 and the recovery zone 30, along which the particles within the treated slurry axially migrate, are defined along interior cylindrical surfaces of the jig screen.

Stratification zone 20 is constructed so as to prohibit outward radial passage of particles in the slurry, while permitting fluid pulsations to be imparted to the slurry during rotation of the jig screen. This results in layering of particles within the slurry according to the specific gravity of the particles making up the slurry before the particles reach the recovery zone 30.

The pulsating action that occurs in the stratification zone can be the result of two different actions. First, it can be produced by pulsating fluid through a rigid permeable layer or membrane containing openings of a size that prohibits outward passage of the slurry particles. Secondly, it can be produced by directing fluid pulsations against the outside surface of a flexible non-permeable membrane that moves inwardly and outwardly in response to the pulses to which it is subjected.

The stratification zone 20 and recovery zone 30 can be separately formed of differing screen or membrane materials. They also can be formed by simply lining a portion of the interior axial length of the jig screen at its incoming axial end.

FIGS. 2 and 3 illustrate stratification zones 20 formed within a supporting jig screen. In FIG. 2, zone 20 is formed as a permeable rigid screen 40. In FIG. 3, it is formed as a flexible non-permeable membrane 41.

Figure 1:
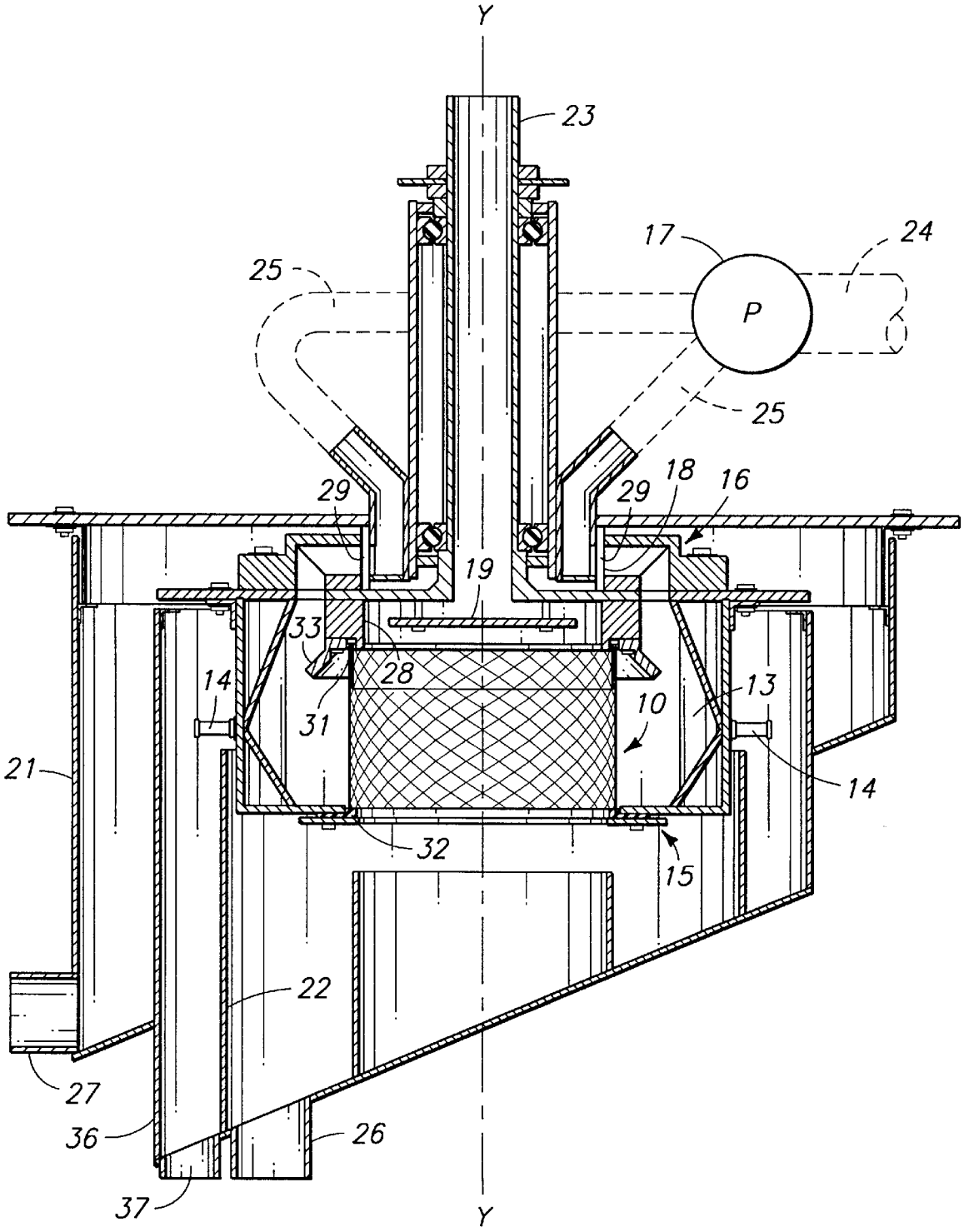
FIG. 1 is simplified cross-sectional view illustrating the modified centrifugal jig.

As shown in FIGS. 1 and 2, the centrifugal jig includes a rotor 15 movably mounted for rotation about the central axis Y—Y. During operation of the jig, a protruding hollow drive shaft 23 on rotor 15 is powered by a motor and a suitable power transmission apparatus (not shown). The hollow drive shaft 23 also serves as a slurry inlet, the slurry being propelled downwardly by gravity. The falling slurry drops onto a circular plate 19, which flings it radially outward to a cylindrical baffle ring 28 leading to the interior of the jig screen 10.

The rotor includes annular jig screen 10 and a surrounding hollow hutch 13. The interior of hutch 13 is normally filled with fluid (gaseous or liquid) during operation of the centrifugal jig. Its interior leads to at least one hutch outlet 14.

A pulsator 16 is provided on the centrifugal jig to direct periodic fluid pulsations into the rotating hutch 13. Pulsations are imparted radially inward against the circumference of the jig screen 10 as it rotates about the central axis Y—Y. Pulsator 16 might include a conventional pump 17 having an inlet conduit at 24 and multiple outlets 25 leading to an annular hollow pulse ring 18 as detailed in referenced U.S. Pat. No. 4,998,986. As radial openings 29 within the pulse ring 18 pass the exit of each outlet 25, the interior of pulse ring 18 will be abruptly subjected to the pressurized fluid flow imparted by pump 17. This will create individual jigging pulses that are then imparted to fluid within the hutch 13 and to the particles within the jig screen 10.

As in prior centrifugal jigs, recovery zone 30 has screen openings formed through the jig screen that permit outward radial passage of slurry particles from the interior rotating slurry. The same screen openings also permit fluid pulsations from within hutch 13 to be directed radially inward against the particles within the slurry as the jig screen 10 is rotated at a high speed.

A stationary casing in the form of a shroud 21 surrounds the rotor 15. It includes a first annular partition 22 that collects the lightweight fraction of the slurry discharged from the end of recovery zone 30 in the jig screen 10. It further includes a second annular partition 36 that collects the heavy fraction of the slurry which passes radially outward through the openings along the recovery zone 30.

The entire interior volume of shroud 21 is normally maintained full of fluid during machine operation. Excess or return fluid can be delivered from a hutch outlet 27 to the pump inlet 24. Particles within the lightweight fraction are discharged at an outlet 26 at the bottom of the first annular partition 22. Particles within the heavy fraction are discharged at an outlet 37 at the bottom of the second annular partition 36.

Details with respect to the construction of split screen 10 can be seen in the structural alternatives illustrated in FIGS. 2 and 3.

The jig screens are expendable elements in the centrifugal jig, and are constructed so as to be readily replaceable when required. Each jig screen 10 is in the form of a cylindrical drum having an upper support rim 31 and a protruding lower support rim 32. Embedded between them are the screens and supports required to maintain the structural integrity of the jig screen during use.

The upper support rim 31 is adapted to be bolted or clamped between the baffle ring 28 on rotor 15 and a conical flange 33 that assists in directing radial fluid flow about the exterior of the jig screen. The lower support rim 32 is bolted or clamped to the bottom surfaces of hutch 13.

In the embodiment shown in FIG. 2, the jig screen 10 is formed about a cylinder of expanded metal 34 that supports a full length section of jig screening 35 leading between supporting rings 31 and 32. To form the stratification zone 20, a short cylinder of fine screen 40 overlaps a portion of the interior surfaces of the screening material 35. The screen 40 leads between the supporting ring 31 and the recovery zone 30. Its lower edge 11 forms the demarcation line between the stratification zone 20 and the recovery zone 30.

In this arrangement, the screening material 35 would be provided with openings of a size permitting radial movement of the prescreened particles within the incoming slurry that is to be separated. The screen 40 would have much smaller openings, selected so as to have a size substantially preventing movement of particles through it while permitting movement of liquid. In this manner, liquid pulsations can be transmitted through screen 40 directly to the particles being stratified, but the particles cannot move outwardly beyond the interior screen surface. Thus, stratification can occur as the slurry moves axially along the screening material 36, but separation of particles will not occur until the particles have axially travelled beyond edge 11.

The jig screen 10 shown in FIG. 3 is essentially similar to that shown in FIG. 2. Identical reference numerals have been used in both FIGS. 2 and 3 to designate corresponding elements within them. The one difference presented in FIG. 3 is that the screen 40 of FIG. 2 is replaced by a flexible cylindrical membrane 41. The membrane 41 is imperforate. It does not permit any passage of water, but vibrations can be transmitted through membrane 41 in response to fluid pulsations directed into the rotating hutch 13 of rotor 15.

The method for separating the heavy and lightweight fractions of a slurry during operation of the centrifugal jig can be summarized in the following steps:

(a) Forming the jig screen as a "split screen" having an axial stratification zone 20 that leads to an axial recovery zone 30;

(b) Introducing slurry onto the stratification zone 20 of the rotating jig screen 10;

(c) Prohibiting outward radial passage of particles in the slurry along the stratification zone 20, while permitting fluid pulsations to be imparted to the slurry as it flows across the stratification zone 20 to form cylindrical layers of particles in the slurry prior to it reaching the recovery zone 30;

(d) Directing fluid pulsations radially inward against the circumference of the rotating jig screen 10 through openings formed through the recovery zone 30 of the jig screen 10 of a size permitting passage of particles in the slurry as it flows across the recovery zone 30;

(e) Collecting a lightweight fraction of the slurry discharged from one end of the recovery zone 30; and (f) Collecting a heavy fraction of the slurry that is passed radially outward through the openings along the recovery zone 30.

By stratifying the slurry prior to its separation in the centrifugal jig, the entrapment of lightweight particles in the heavier particles that are migrating radially outward due to centrifugal forces and radial pulsations is substantially minimized. This produces a cleaner final product.

With a split screen as described, the incoming particles of the homogenous slurry cannot pass radially outward through the initial section of screen 40, or membrane 41, which are labeled as stratification zone 20. However, the incoming particles (both lightweight and heavy) are subjected to centrifugal forces and to fluid pulsations as the particles migrate axially along the direction of axis Y—Y.

Stratification of the slurry is achieved before the particles reach s the first annular end 11 of the recovery zone 30, where the particles within the slurry first enter the area about jig screen 10 that permits outward passage of particles. Recovery zone 30 has screen openings that are larger than the particles within the slurry. But now only the heavy particles will pass through the rotating jig screen because of the stratified nature of the slurry.

Experimental use to this date has shown that effective stratification is achieved by using a stratification zone 20 that is approximately 20–40 percent of the total screen height. The exact height for a specific application of the equipment must be determined experimentally to present the minimum height at which full prestratification occurs, since the presence of zone 20 reduces the effective height of recovery zone 30 along which separation of particles takes place. The use of the stratification zone does decrease throughput of the centrifugal jig because it reduces the separating screen area in comparison to a jig screen having no stratification zone.

In one specific example used to date, the screen size for screening material 35 in the jig screen was sized as 40 mesh and the screen 40 was sized as 150 mesh. Each constituted a single layer of screen. They were both supported by a common network of expanded metal. They were made from conventional woven screen, but screening of a "wedge wire" construction can be used as an alternative. If "wedge wire" screening is used, the slots within it can be vertical or horizontal. When the slots are horizontal, the separation between wires can be different in the two described zones 20 and 30.

A membrane 41, as illustrated in FIG. 3, should be used when the finer screening material might become clogged by particles being prestratified. A membrane can be made from any flexible resilient material, such as plastic sheeting, rubber, and reinforced composites such as Tyvek (TM).

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A centrifugal jig for separating a heavy fraction from a lightweight fraction of a slurry, comprising:

an annular jig screen rotatably mounted about a central axis;

the jig screen having a recovery zone extending along its central axis between a first annular end where slurry enters the recovery zone and a second annular end where a lightweight fraction of the slurry is discharged;

the jig screen further having a stratification zone contiguous to said recovery zone extending along its central axis and leading to the first annular end of the recovery zone;

feed means for introducing slurry onto the stratification zone of the jig screen;

the stratification zone comprising a layer of material constructed so as to prohibit outward radial passage of particles in the slurry through said layer while permitting fluid pulsations to be imparted inwardly through said layer to the slurry during rotation of the jig screen to prestratify the slurry prior to it reaching the recovery zone;

the recovery zone comprising a layer of material having openings formed therethrough of a size permitting passage of particles in the slurry and through which fluid pulsations are directed to the slurry during rotation of the jig screen;

a first receiver for collecting the lightweight fraction of the slurry discharged from the rotating jig screen; and a second receiver for collecting a heavy fraction of the slurry passed radially outward through the openings along the recovery zone of the rotating jig screen.

2. The centrifugal jig of claim 1, wherein the stratification zone comprises a layer of rigid material.

3. The centrifugal jig of claim 1, wherein the stratification zone comprises a layer of flexible material.

4. The centrifugal jig of claim 1, wherein the stratification zone comprises a layer of material that is permeable, the openings of the layer of permeable material preventing radially outward passage of particles in the slurry.

5. The centrifugal jig of claim 1, wherein the stratification zone comprises a layer of rigid material that is permeable, the size of the openings of the layer of permeable material preventing radially outward passage of particles in the slurry.

6. The centrifugal jig of claim 1, wherein the stratification zone comprises a flexible layer of material that is non-permeable.

7. The centrifugal jig of claim 1, wherein the jig screen is cylindrical.

8. The centrifugal jig of claim 1, wherein the jig screen is cylindrical and has a substantially constant inside diameter along the full lengths of the stratification and recovery zones.

9. The centrifugal jig of claim 1, wherein the central axis of the jig screen is vertical and the jig screen is cylindrical, the jig screen having a substantially constant inside diameter along the full lengths of the stratification and recovery zones.

10. The centrifugal jig of claim 1, wherein the central axis of the jig screen is vertical, the stratification zone being above the recovery zones along the axial length of the jig screen.

11. A centrifugal jig for separating a heavy fraction from a lightweight fraction of a slurry, comprising:

a rotor movably mounted for rotation about a central axis, the rotor including an annular jig screen and a surrounding hollow hutch, the hutch having an interior normally filled with fluid during operation of the centrifugal jig and leading to at least one hutch outlet;

a pulsator to direct fluid pulsations into the rotating hutch and radially inward against the circumference of the jig screen as it rotates about the central axis;

the jig screen having a recovery zone extending along the central axis between a first annular end where slurry enters the recovery zone and a second annular end where a lightweight fraction of the slurry is discharged;

the jig screen further having a stratification zone contiguous to said recovery zone extending along the central axis and leading to the first annular end of the recovery zone;

feed means for introducing slurry onto the stratification zone of the jig screen;

the stratification zone comprising a layer of material constructed so as to prohibit outward radial passage of particles in the slurry through said layer during rotation of the jig screen while permitting fluid pulsations to be imparted inwardly through said layer to the slurry by operation of the pulsator to pre-stratify the slurry prior to it reaching the recovery zone;

the recovery zone comprising a layer of material having openings formed therethrough of a size permitting passage of particles in the slurry in response to rotation of the jig screen and through which fluid pulsations are directed to the slurry by operation of the pulsator;

a stationary shroud surrounding the rotor;

the stationary shroud including a first annular partition for collecting the lightweight fraction of the slurry discharged from the rotating jig screen, and a second annular partition for collecting a heavy fraction of the slurry passed radially outward through the openings along the recovery zone of the rotating jig screen.

12. The centrifugal jig of claim 11, wherein the stratification zone along the jig screen has a rigid interior lining.

13. The centrifugal jig of claim 11, wherein the stratification zone along the jig screen has a flexible interior lining.

14. The centrifugal jig of claim 11, wherein the stratification zone along the jig screen has an interior lining that is permeable, the openings of the permeable lining preventing radially outward passage of particles in the slurry.

15. The centrifugal jig of claim 11, wherein the stratification zone along the jig screen has a rigid interior lining that is permeable, the size of the openings of the permeable lining preventing radially outward passage of particles in the slurry.

16. The centrifugal jig of claim 11, wherein the stratification zone along the jig screen has a flexible interior lining that is non-permeable.

17. An annular jig screen formed about a central axis for use within a centrifugal jig that separates a heavy fraction from a lightweight fraction of a slurry, the jig screen comprising:

a recovery zone extending along the central axis between a first annular end where slurry enters the recovery zone and a second annular end where a lightweight fraction of the slurry is discharged;

a stratification zone contiguous to said recovery zone extending along the central axis and leading to the first annular end of the recovery zone;

the stratification zone comprising a layer of material constructed so as to prohibit outward radial passage of particles in the slurry through said layer while permitting fluid pulsations to be imparted inwardly through said layer to the slurry during rotation of the jig screen to prestratify the slurry prior to it reaching the recovery zone;

the recovery zone comprising a layer of material having openings formed therethrough of a size permitting passage of particles in the slurry and through which fluid pulsations are directed to the slurry during rotation of the jig screen.

18. The jig screen of claim 17, wherein the stratification zone comprises a layer of rigid material.

19. The jig screen of claim 17, wherein the stratification zone comprises a layer of flexible material.

20. The jig screen of claim 17, wherein the stratification zone comprises a layer of material that is permeable, the openings of the layer of permeable material preventing radially outward passage of particles in the slurry.

21. The jig screen of claim 17, wherein the stratification zone comprises a layer of rigid material that is permeable, the size of the openings of the layer of permeable material preventing radially outward passage of particles in the slurry.

22. The jig screen of claim 17, wherein the stratification zone comprises a flexible layer of material that is non-permeable.

23. The jig screen of claim 17, wherein the jig screen is cylindrical.

24. The jig screen of claim 17, wherein the jig screen is cylindrical and has a substantially constant inside diameter along the full lengths of the stratification and recovery zones.

25. A method of separating a heavy fraction from a lightweight fraction of a slurry on a centrifugal jig having a rotor including an annular jig screen rotatably mounted about a central axis; comprising the following steps:

forming the jig screen with an axial stratification zone and an adjacent axial recovery zone;

rotating the jig screen;

introducing slurry onto the stratification zone of the rotating jig screen; and causing it to flow across the stratification zone to and across the recovery zone;

prohibiting outward radial passage of particles in the slurry through the stratification zone of the rotating jig screen while imparting fluid pulsations inwardly through the stratification zone to the slurry as it flows across the stratification zone of the rotating jig screen to pre-stratify the slurry prior to it reaching the recovery zone;

directing fluid pulsations radially inward against the circumference of the rotating jig screen through openings formed through the recovery zone of the jig screen, said openings being of a size permitting passage of particles in the slurry as it flows across the recovery zone of the rotating jig screen;

discharging the slurry from one end of the recovery zone while collecting a lightweight fraction of the slurry so discharged; and passing a heavy fraction of the slurry radially outward through the openings along the recovery zone of the rotating jig screen and collecting the fraction so passed.

26. The method of claim 25, wherein the step of prohibiting outward radial passage of particles in the slurry along the stratification zone of the rotating jig screen is accomplished by flowing the slurry along a layer of rigid material.

27. The method of claim 25, wherein the step of prohibiting outward radial passage of particles in the slurry along the stratification zone of the rotating jig screen is accomplished by flowing the slurry along a layer of flexible material.

28. The method of claim 25, wherein the step of prohibiting outward radial passage of particles in the slurry along the stratification zone of the rotating jig screen is accomplished by flowing the slurry along a layer of material that is permeable, the size of the openings in the layer of permeable material preventing radially outward passage of particles in the slurry.

29. The method of claim 25, wherein the step of prohibiting outward radial passage of particles in the slurry along the stratification zone of the rotating jig screen is accomplished by flowing the slurry along a layer of rigid material that is permeable, the size of the openings in the layer of permeable material preventing radially outward passage of particles in the slurry.

30. The method of claim 25, wherein the step of prohibiting outward radial passage of particles in the slurry along the stratification zone of the rotating jig screen is accomplished by flowing the slurry along a flexible layer of material that is non-permeable.

31. The method of claim 25, wherein the step of prohibiting outward radial passage of particles in the slurry along the stratification zone of the rotating jig screen is accomplished by flowing the slurry along a jig screen that is cylindrical.

32. The method of claim 25, wherein the step of prohibiting outward radial passage of particles in the slurry along the stratification zone of the rotating jig screen is accomplished by flowing the slurry along a jig screen that is cylindrical and has a substantially constant inside diameter along the full lengths of the stratification and recovery zones.

* * * * *